US006432241B1

(12) United States Patent
Congard et al.

(10) Patent No.: US 6,432,241 B1
(45) Date of Patent: Aug. 13, 2002

(54) SPLICING TAPE, SPLICING METHOD AND ASSEMBLY COMPRISING THE SPLICING TAPE

(75) Inventors: Pierre M. Congard, Jouy-le-Moutier; Richard Sabatier, Paris; Jean-Philippe Weber, Pessat-Villeneuve, all of (FR)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/623,295

(22) PCT Filed: Feb. 11, 1999

(86) PCT No.: PCT/US99/03058

§ 371 (c)(1),
(2), (4) Date: Sep. 1, 2000

(87) PCT Pub. No.: WO99/46196

PCT Pub. Date: Sep. 16, 1999

(30) Foreign Application Priority Data

Mar. 13, 1998 (EP) ..... 98104565

(51) Int. Cl.[7] ..... B65H 69/06; B31F 5/06

(52) U.S. Cl. ..... 156/157; 242/555.3; 242/555.4; 242/556.1; 428/57; 428/343

(58) Field of Search ..... 156/157, 159, 156/502, 504; 242/551, 553, 555.3, 555.4, 556.1; 428/41.7, 41.8, 57, 343

(56) References Cited

U.S. PATENT DOCUMENTS

| | | | | |
|---|---|---|---|---|
| 4,388,432 A | | 6/1983 | Eskay | |
| 4,413,080 A | | 11/1983 | Blake | |
| 4,482,675 A | | 11/1984 | Witt | |
| 4,569,960 A | | 2/1986 | Blake | |
| 5,032,460 A | | 7/1991 | Kantner et al. | |
| 5,102,733 A | | 4/1992 | Zawadzki | |
| 5,125,995 A | | 6/1992 | D'Haese et al. | |
| 5,202,190 A | | 4/1993 | Kantner et al. | |
| 5,212,002 A | * | 5/1993 | Madrzak et al. | 242/556.1 |
| 5,348,793 A | * | 9/1994 | Stettner | 242/556.1 |
| 5,380,779 A | | 1/1995 | D'Haese | |

FOREIGN PATENT DOCUMENTS

| | | |
|---|---|---|
| DE | 92 01 286 U | 5/1992 |
| DE | 92 15 731 U | 3/1993 |
| DE | 196 32 689 A | 2/1998 |
| EP | 0 566 880 A | 10/1993 |
| EP | 0 618 509 | 5/1994 |
| EP | 0 818 408 A | 1/1998 |
| GB | 2 294 235 A | 4/1996 |
| WO | WO 95/29115 | 11/1995 |

OTHER PUBLICATIONS

"Acrylic Adhesives" Handbook of Pressure Sensitive Adhesive Technology, Second Edition, pp. 396–456 (D. Satas, editor); Van Nostrand Reinhold, New York.

* cited by examiner

*Primary Examiner*—Mark A. Osele
(74) *Attorney, Agent, or Firm*—Melissa E. Buss

(57) ABSTRACT

Splicing tape for splicing a leading edge portion of a roll of sheet material to a further sheet comprising a carrier layer having on a first major surface a first adhesive layer and on a second major surface opposite to the first major surface in the order given a non-tacky polymer layer and a second adhesive layer. The splicing tape being capable of delamination between the carrier layer and the non-tacky polymer layer when preparing the splice.

13 Claims, 6 Drawing Sheets

SPLICING TAPE, SPLICING METHOD AND ASSEMBLY COMPRISING THE SPLICING TAPE

METHOD OF SPLICING

FIELD OF THE INVENTION

The present invention relates to a method of preparing a flying or permanent splice between a first and second sheet material, to the splices thus obtained and to splicing tapes suitable for splicing a leading edge portion of the outer turn of a roll of sheet material to another sheet material.

BACKGROUND OF THE INVENTION

Splicing tapes can be used for preparing a joint between two sheet materials such as, for example, between the leading edge portion of the outer turn of a roll of sheet material and another sheet material. The splicing operation can be performed in a static or a dynamic mode.

In the static mode the first and second sheet material may be positioned first in the desired configuration relative to each other, and one or more splicing tapes are then applied in order to join the two sheets together. It is also possible to apply the splicing tape or tapes to one of the sheet materials first. Then the second sheet material is provided, positioned in the desired configuration and the two sheet materials are joined. Splices which are obtained in a static mode of preparation are often referred to as permanent splices. Depending on the configuration of the two sheet materials relative to each other, it can be differentiated between butt splices, overlap splices and staggered overlap splices, respectively. The different configurations are shown and explained in WO 95/29,115.

It is often desirable, however, to prepare splices in a dynamic mode. This allows, for example, in the printing industry, to join the leading edge of the new roll of paper sheet material to the trailing edge of the old, depleting roll of paper sheet material without requiring interruption of the continuous production process. Splices which are obtained in a dynamic mode of operation, are usually referred to as flying splices. A conventional way of making a flying splice tape uses destructible nose tabs as is described in WO 95/29,115. In a first step the new roll is appropriately prepared or "dressed" for splicing, as is shown in FIG. 1*a* which was taken from WO 95/29,115. The leading edge 35 of the outermost turn 32 of the new roll of sheet material 30 is cut, for example, in the form of a W or V or in another appropriate shape. A double-sided adhesive tape 24 is applied to the leading edge portion of the outermost turn 32 which is releasably adhered to the next-to-the-outer turn 31 by the nose tabs 23. The new roll of sheet material 30 is then accelerated to the same speed as the running web sheet of the previous, depleting roll. The running web sheet is then pressed against the new roll 30 and pasted to the double-sided adhesive tape 24 on the outermost turn 32 of the new roll 30. The previous roll is typically cut off from the running web sheet. The nose tab is then subjected to the tractive force exerted by the running web sheet. The nose tab breaks thereby releasing the temporary joint between the outer turn 32 and the next-to-the-outer turn 31 of the new roll of sheet material 30.

An alternative configuration for applying a flying splice which is used in the state-of-the-art is shown in FIG. 1*b* which was adapted from WO 95/29,115.

A nose tab which is suitable for preparing a flying splice is described in GB 2,294,235. As can be seen from this reference, the nose tab comprises two adhesive layers which are adhered to the under-surface of the leading edge portion of the outer turn and the upper-surface of the next-to-outer turn, respectively. The nose tab furthermore comprises two thin paper layers which are attached to two adhesive layers and embrace a silicon lacquer layer. The new roll of sheet material is then furthermore prepared by applying a double-sided adhesive tape to the leading edge of the outer turn to provide a configuration similar to that of FIGS. 1*a* or 1*b*, respectively. When making the splice, the paper web sheet from the depleting roll which is advanced, is adhered to the exposed part of the adhesive layer and the exposed adhesive layer of the double-sided tape, thereby causing the lacquer layer to cohesively split into two parts. On breaking the nose tab of GB 2,294,235 leaves behind two non-tacky surfaces.

Both permanent and flying splices should provide a flexible, strong connection between the two sheet materials or webs and should maintain substantially all of the properties of the sheet material; for example, if the sheet material is paper which can be printed or coated, the splice is preferably thin, flexible, printable, coatable and also repulpable. When using configurations like those of FIGS. 1*a* and 1*b* for preparing a flying splice, it is important that air cannot enter beneath the leading edge 35 of the outer turn 32 which would result in the roll unwinding itself at very high speeds thus interrupting the continuous production. In order to prevent air entering beneath the leading edge 35 of the outer turn 32, small destructible adhesive tabs 26 are sometimes applied not only at the noses of the leading edge 35 but, for example, also along the diagonal edges of the leading edge 35 in FIG. 1*a* or over the lateral edges of the leading portion 34 of the outer turn 32 to the sides of the roll 30 (see FIG. 1*b*). Configurations like those of FIGS. 1*a* and 1*b* are time consuming to apply and require the application of double-sided adhesive tapes and destructible nose tabs.

Another flying splice multi-layer film or multi-layer adhesive, respectively, is disclosed in German utility model DE 92 01 286.8 U1 comprising perforated and non-perforated embodiments. The non-perforated embodiments are required to exhibit a low adhesive force so that the new paper web is easily released after splicing. It is furthermore required that the open adhesive spots which are exposed upon splicing are specifically modified so that they do not stick to rolls, cylinders, rods and spindles. It is disclosed that these requirements can be fulfilled by specifically selecting pressure-sensitive adhesives, permanent adhesives and surfaces, which stick to each other but not to other surfaces such as rolls, spindles and cylinders.

It was therefore an object of the present invention to provide a splicing tape and a method of preparing a flying splice which does not require using a destructible nose tab in combination with a double-sided adhesive tape. It was another object of the present invention to provide a splicing tape which allows to reliably and easily prepare a new roll of sheet material 30 for making a splice and, in particular, for making a flying splice which on delamination leaves behind two non-tacky surfaces. It was another object of the present invention to provide a splicing tape with the peeling force required to delaminate the splicing tape being adjustable within wide limits. Other objects of the present invention can be taken from the following description of the invention.

BRIEF DESCRIPTION OF THE INVENTION

The present invention refers to a method of splicing a leading edge portion of the outer turn of a roll of sheet material to a further sheet comprising the steps of (i) providing a splicing tape comprising a carrier layer having on a first major surface a first adhesive layer and on a second major surface opposite to the first major surface in the order given an adhesion-controlling layer, a non-tacky polymer layer and a second adhesive layer, the splicing tape being capable of delamination between the carrier layer and the adhesion-controlling layer or between the non-tacky polymer layer and the adhesion-controlling layer, respectively, when preparing the splice, (ii) positioning said tape on and adhering it by means of one of the adhesive layers, to the portion of the upper surface of the next-to-the-outer turn of the roll of sheet material facing the leading edge portion of the outer turn so that the other adhesive layer of the splice tape can be fully or partly adhered to the under-surface of the leading edge portion of the outer turn, (ii) adhering the other adhesive layer of the splice tape fully or partly to the under-surface of the leading edge portion of the outer turn of the roll of sheet material, (iv) optionally providing an adhesive tape having a first adhesive surface and a second adhesive surface, and adhering one of the adhesive surfaces to the upper surface of the leading edge portion of the outer turn of the roll of sheet material, (v) adhering the further sheet to the optionally partially exposed surface of the other adhesive surface of the splicing tape and/or to the exposed surface of the other adhesive layer of said optional adhesive tape, and (vi) separating the further sheet and the outer turn of the roll spliced to it, from the next-to-the-outer turn of the roll thereby effecting delamination between the carrier layer and the non-tacky polymer layer of the splicing tape.

The present invention furthermore refers to a splicing tape suitable for splicing a leading edge portion of the outer turn of a roll of sheet material to another sheet material, said splicing tape comprising a carrier layer having on a first major surface a first adhesive layer and on a second major surface opposite to the first major surface in the order given an adhesion-controlling layer, a non-tacky polymer layer and a second adhesive layer, the splicing tape being capable of delamination between the carrier layer and the adhesion-controlling layer or between the non-tacky polymer layer and the adhesion-controlling layer, respectively, when preparing the splice.

The present invention furthermore refers to a flying or permanent splice between a first and a second sheet material which is obtainable by using splicing tape according to the present invention.

DETAILED DESCRIPTION OF THE INVENTION

In connection with the present invention, the term of "non-tacky polymer layer 14" as used above and below, denotes a polymer layer that is not tacky at ambient conditions of humidity and temperature.

The term "delamination" as used above and below refers to an adhesive destruction mode of the splicing tape 10 whereby the splicing tape 10 separates between two adjacent layers so as to leave exposed the surfaces of the adjacent layers which had been in contact with each other previously.

The term "splitting" as used above and below refers to a cohesive destruction mode of the splicing tape 10 whereby the splicing tape 10 breaks through one of its layers so as to leave exposed two inner surfaces of such layer.

Figure 2:
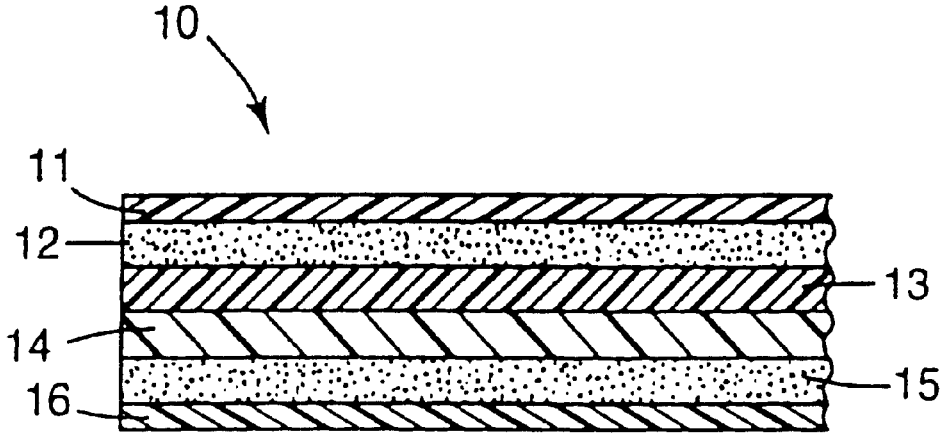
FIG. 2 shows an embodiment of a splicing tape 10 comprising in the order of sequence a first release liner 11, a first adhesive layer 12, a carrier layer 13, a non-tacky polymer layer 14, a second adhesive layer 15 and a second release liner 16.
Figure 3:
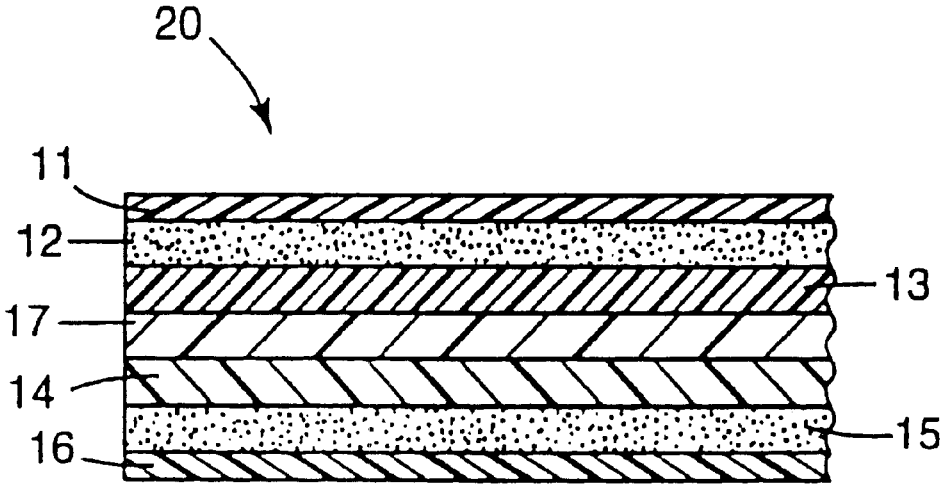
FIG. 3 shows an embodiment of the splicing tape 10 according to the present invention additionally comprising an adhesion-controlling layer 17 between the carrier layer 13 and the non-tacky polymer layer 14.

A first embodiment of a splicing tape 10 is shown in FIG. 2. The splicing tape comprises a carrier layer 13 having on a first major surface a first adhesive layer 12 and on a second major surface opposite to the first major surface in the order given a non-tacky polymer layer 14 and a second adhesive layer 15. A preferred embodiment of a splicing tape 10 according to the present invention which is shown in FIG. 3, differs from the embodiment of FIG. 2 in that it additionally comprises an adhesion-controlling layer 17 between the non-tacky polymer layer 14 and the carrier layer 13.

The adhesive layers 12 and 15 of the splicing tape 10 of the present invention can be the same or different but preferably are the same. The adhesive layers 12 and 15 may include any known adhesive that permanently and strongly adheres to the outer turn 32 and next-to-the-outer turn 31 of the new roll 30 and to the further sheet material the leading edge portion 34 of the outer turn 32 is to be spliced to. Examples include pressure sensitive adhesives, heat activated adhesives, thermosetting type adhesives and remoistenable adhesives. Particularly preferred adhesives include pressure sensitive adhesives which may be hot-melt adhesives, essentially solvent or water-free adhesives or solvent- or water-based dispersions or solutions. Specific pressure sensitive adhesives include acrylate-based pressure sensitive adhesives, styrene-isoprene block copolymers, acrylic ester-vinyl acetate copolymers, ethylene-vinyl acetate copolymers, plasticized vinyl acetate homopolymers and rubber-latex resin emulsion systems. In the practice of preferred embodiments of the invention, the adhesive composition comprises an acrylate-based pressure sensitive adhesive. Acrylate-based pressure sensitive adhesives useful in practicing the invention comprise polymers of one or more monomers of (meth)acrylic acids and optionally other copolymerizable monomers containing functional groups in addition to an ethylenically unsaturated group. The acrylate-based pressure sensitive adhesive may comprise conventional additives such as, for examples, fillers, anti-oxidants, flame-retardants, pigments, plasticizers or polymer additives. By varying the nature and amount of the monomers and the nature and amount of the additives, the cohesive properties of the resulting adhesive can be changed as is known in the art.

Examples of acrylate-based pressure sensitive adhesives which are suitable in the practice of the invention are described in Satas, "Acrylic Adhesives," *Handbook of Pressure-Sensitive Adhesive Technology, 2nd ed.,* pp. 394–456 (D. Satas, ed.), Van Nostrand Reinhold, New York (1989).

A particularly suitable acrylate based pressure sensitive adhesive includes copolymers of an acrylic or methacrylic acid and an alkyl acrylate or methacrylate wherein the alkyl group has at least 4 carbon atoms, typically 4 to 14 carbon atoms. Examples of such alkyl acrylates or methacrylates include n-butyl, n-pentyl, n-hexyl, cyclohexyl, isoheptyl, n-nonyl, n-decyl, isohexyl, isobornyl, 2-ethyloctyl, isooctyl, and 2-ethylhexyl acrylates and methacrylates. Preferred alkyl acrylates include isooctyl acrylate, 2-ethylhexyl acrylate, n-butylacrylate and cyclohexyl acrylate. A particularly preferred alkyl acrylate is isooctyl acrylate. Particularly preferred alkyl methacrylates include butyl methacrylate, cyclohexyl methacrylate, and isobornyl methacrylate.

In accordance with a highly preferred embodiment in connection with this invention, the adhesive layers 12 and 15 comprise a repulpable adhesive. A preferred repulpable adhesive for use in this invention has a rating of not more than 3 in the European repulpability test described in U.S. Pat. No. 5,380,779. Examples of repulpable adhesives for use in the invention include the repulpable adhesives disclosed in U.S. Pat. No. 5,380,779, U.S. Pat. No. 4,413,080, U.S. Pat. No. 4,569,960, U.S. Pat. No. 4,482,675, U.S. Pat. No. 4,388,432, U.S. Pat. No. 5,102,733 and U.S. Pat. No. 5,125,995. The thickness of the adhesive layers 12 or 15 can be varied widely but is typically independent of each other between 10 $\mu$m and 200 $\mu$m and preferably between 10 $\mu$m and 50 $\mu$m.

The carrier layer 13 can be, for example, of any material commonly used for backings of tapes and includes paper layers as well as plastic films. Suitable carrier layers include polyethylene films, polypropylene films, polyester films, polyethylene or polypropylene coated papers, Kraft papers and non-woven materials. In case paper is used at carrier layer 13, it is preferred to use smooth papers of low porosity. Paper carrier layers 13 are preferred because of their repulpability. The thickness of carrier layer 13 is typically between 30 $\mu$m and 250 $\mu$m and preferably between 40 $\mu$m and 100 $\mu$m.

Examples of polymers for use in the non-tacky polymer layer 14 of the splicing tape 10 of this invention include polyvinyl chlorides, polyvinylidene chlorides, polyvinyl alcohols such as Mowiol™ 4/88 available from Clariant, polyvinylacetates, polyvinyl pyrrolidones and copolymers of vinylchloride and vinylacetate such as UCAR™ vinyl VYES and UCAR™ vinyl VMCA both commercially available from Union Carbide. The non-tacky polymer layer 14 may contain additives in addition to the polymer. For example, the non-tacky polymer layer 14 may additionally contain wetting agents, defoamers, plasticizers and fungicides. A particularly preferred non-tacky polymer layer comprises a repulpable polymer such as polyvinylalcohol. A non-tacky polymer layer 14 containing a polyvinylalcohol preferably also contains a plasticizer or combination of plasticizers. Particularly preferred plasticizers for use in a polyvinyl alcohol based non-tacky polymer layer 14 include a combination of a polyol such as diethylene glycol and a hydroxy-modified rubber such as Kraton™ L 1803 available from Shell. The thickness of the non-tacky polymer layer 14 is preferably between 1 $\mu$m and 40 $\mu$m and more preferably between 10 $\mu$m and 15 $\mu$m.

The splicing tape 10 according to the present invention preferably comprises one or two release liners 11, 16 which are attached to the exposed surfaces of adhesive layers 12, 15 for storage and protection. If the splicing tape is provided in roll form only one release liner having release properties on both surfaces, may be required between the adhesive layers 12, 15. The splicing tape according to the present invention can also be provided, however, in the form of sheets and is then typically protected by two release liners 11, 16.

The release liners 11 and 16 can be selected from a number of known and available papers or films having a release material coated onto one side of the web or on both sides in case of an adhesive tape in the form of a roll. The base paper of the release liner may be selected from krafts, super-calendered krafts, clay coated krafts, glassines, parchments, and other papers and films which have a suitable undercoating for release coating hold-out. The release coating may be any of the known materials used for their release properties for adhesives. Preferred types are silicones and modified silicones, the modification including both copolymerization of silicones with other nonrelease chemical agents or by adding nonsilicone materials to the silicone coating solution prior to application to the release base paper. Other release agents such as polyethylene, fluorocarbons, the Werner-type chromium complexes, and polyvinyl octadecyl carbamate may also be used. The choice of release coating is dependent on the tack, adhesion level, and chemical nature of the adhesive layer 12 or 15. The release liners 11 and 16 are chosen such that when they are removed from the adhesive tape no premature delamination takes place between the carrier layer 13 and the non-tacky polymer layer 14.

Figure 1A:
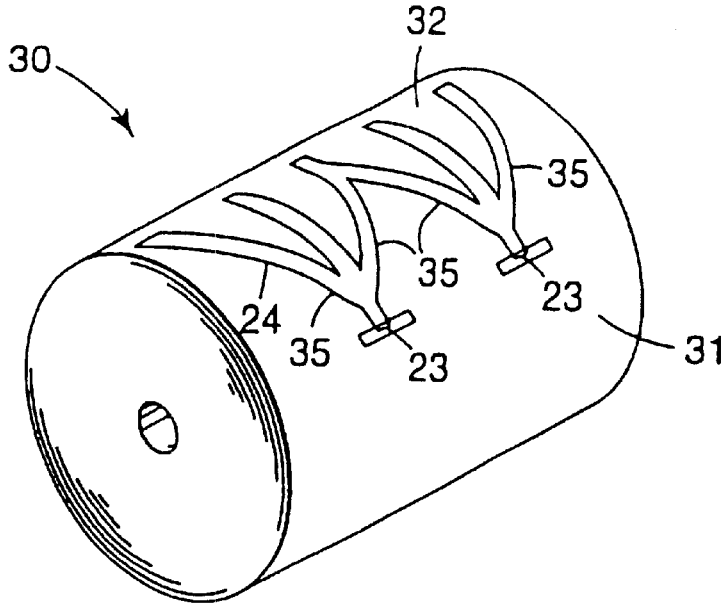
FIGS. 1 *a* and *b* schematically show two prior art configurations for "dressing" a new roll of sheet material 30 for making a flying splice (prior art).
Figure 4:
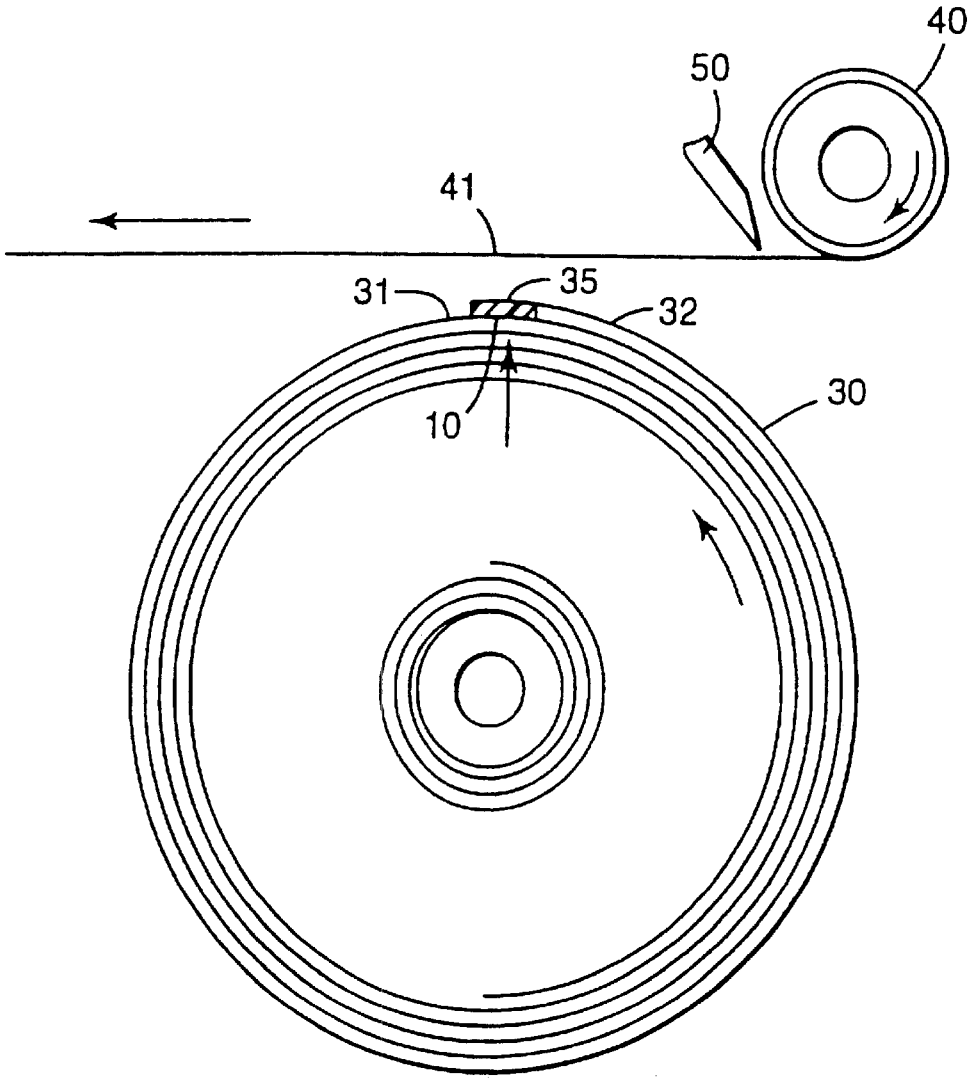
FIG. 4 shows a new roll of sheet material 30 which comprises a splicing tape 10 between the outer turn 32 and the next-to-the-outer turn 31 of the new roll 30.
Figure 5A:
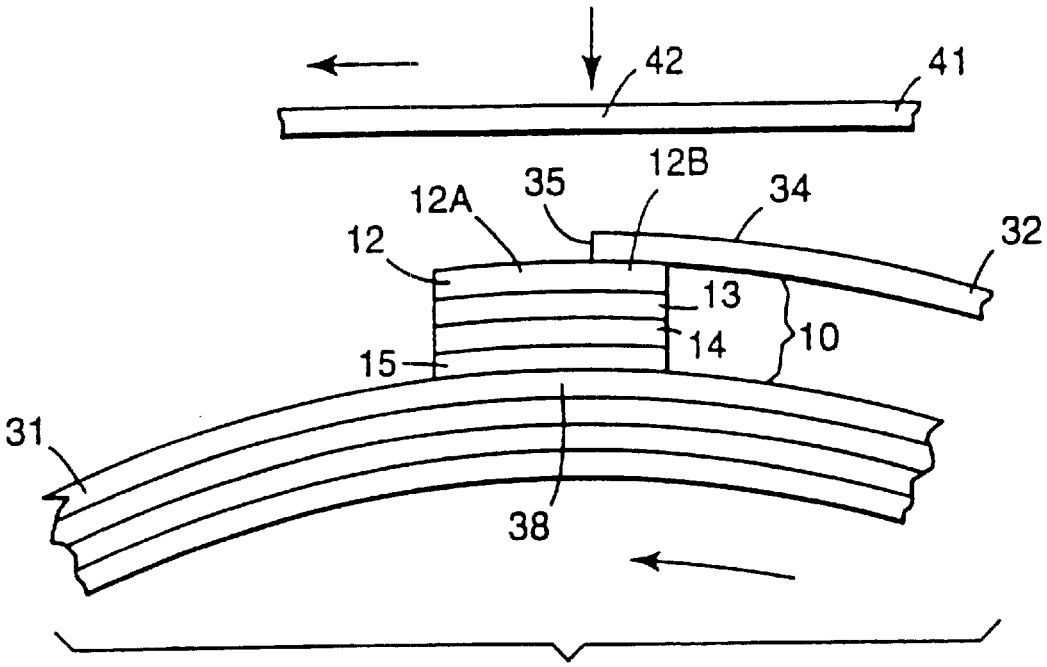
FIG. 5*a* is an enlarged view of the part of FIG. 4 comprising the splicing tape 10, the leading edge 35 of the outer turn 32 of the new roll, the corresponding portions of the next few inner turns of the new roll and portion 42 of the running web sheet 41.
Figure 5B:
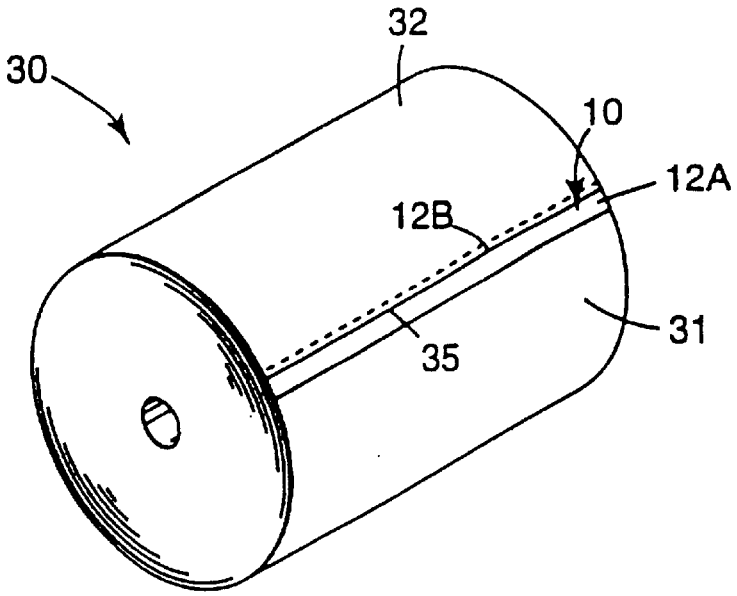
FIG. 5*b* is a perspective view of the new roll of sheet material 30 which is "dressed" for the preparation of a flying splice and comprises a splicing tape 10 applied between the outer turn 32 and the next-to-the-outer turn 31 of the new roll of sheet material 30 along the leading edge 35 of the outer turn 32.

FIG. 4 illustrates a method according to the present invention using the splicing tape 10 for making a flying splice between the trailing end of a depleting roll of sheet material 40 which is being advanced, and a new roll of sheet material 30. FIG. 5*a* shows enlarged and in more detail the leading edge portion 34 of the outer turn 32 of new roll 30, the splicing tape 10 according to FIG. 2 comprising no adhesion-controlling layer 17, the next-to-outer turn 31 of new roll 30 and a few following inner turns of the new roll 30, the running web sheet 41 of the depleting roll 40 and the portion 42 of the running web sheet 41 which is to be connected to the exposed part 12A of adhesive layer 12. The splicing tape 10 is adhered to portion 38 of the upper-surface of the next-to-the-outer turn 31 of the new roll 30 in a way so that the under surface of the leading edge portion 34 next to the leading edge 35 can be adhered to the part 12B of the adhesive layer 12 leaving the part 12A of the adhesive layer 12 exposed. The splicing tape 10 can be applied in various configurations. In a preferred embodiment the splicing tape is applied along essentially all of the leading edge 35 of the new roll 30 in order to effectively suppress lifting of the leading edge by preventing air from entering between the outer turn 32 and the next-to-outer turn 31 at the leading edge 35. A specific embodiment is shown in FIG. 5*b* where the leading edge 35 of the outer turn 32 of the new roll 30 is essentially parallel to the longitudinal symmetry axis of the new roll 30. The splicing tape 10 according to the invention can, however, also be applied as a nose tab, typically together with an additional double-sided adhesive tape which is attached at or close to the leading edge 35 of the outer turn 32 as is shown in FIG. 1*a*.

Figure 6:
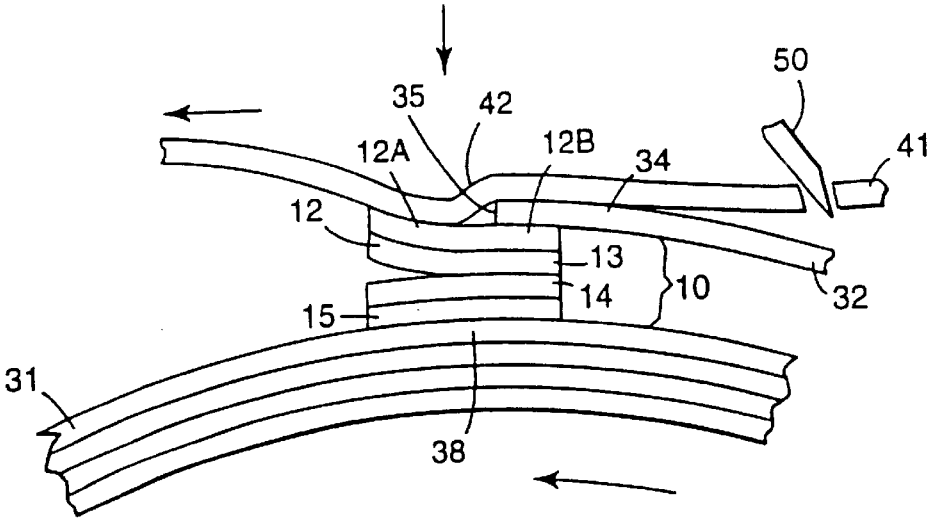
FIG. 6 shows the preparation of a flying splice between portion 42 of the running web sheet 41 of the depleting roll 40 and the outer turn 32 of the new roll of sheet material 30, using the configuration shown in FIG. 5*a* and pressing portion 42 against the exposed surface 12 A of the first adhesive layer 12 of the splicing tape 10.

In order to make the splice, the new roll 30 is rotated about its longitudinal symmetry axis and brought to a peripheral speed commensurate with the linear speed of the running web sheet 41 of the depleting roll 40. In an appropriate moment, when the depleting roll 40 is close to exhaustion and the leading edge 35 of the new roll 30 is in an appropriate rotational position relative to the portion 42 of the running web sheet 41 of the depleting roll 40, the running web 41 is moved, for example, by means of a roller towards the leading edge portion 34 of the outer turn 32 of the new roll 30 so that the under-surface of portion 42 of the running web 41 is adhered to the exposed surface 12A of the first adhesive layer 12 of the splicing tape 10. When traveling out of the area of contact where the running web sheet 41 is adhered to the splicing tape 10, the running web sheet 41 exerts a peeling force onto the splicing tape 10 as is shown in FIG. 6. This effects the splicing tape to delaminate between the carrier layer 13 and the non-tacky polymer layer 14, leaving behind the non-tacky surface of polymer layer 14 on the upper surface of the next-to-the-outer turn 31 and the non-tacky surface of the carrier layer 13 at the splice between the leading edge portion 34 of the outer turn of the new roll 30 and the portion 42 of the running web sheet 41 of the depleting roll 40. The running web sheet 41 is preferably cut essentially simultaneously to or shortly after making the splice by using the cutting device 50 as is indicated in FIG. 6.

The embodiment of the splicing tape 10 according to the present invention which includes an adhesion-controlling layer 17 between the carrier layer 13 and the non-tacky polymer layer 14 as is shown in FIG. 3 is preferred. The adhesion-controlling layer 17 is chosen so that the interface between the adhesion-controlling layer 17 and the carrier layer 13 or the non-tacky polymer layer 14, respectively, becomes the predetermined breaking point of the splicing tape. The carrier layer 13, the non-tacky polymer layer 14 and the adhesion-controlling layer 17 are preferably selected so that the adhesion-controlling layer 17 adheres more strongly to the carrier layer 13 than to the non-tacky polymer layer 14 so that the splicing tape 10 delaminates on peeling between the adhesion-controlling layer 17 and the non-tacky polymer layer 14.

The force f necessary to peel the adhesion-controlling layer 17 from the non-tacky polymer layer 14 is measured as 90° peel adhesion as is described in the test method section below. The force f preferably is between 5 and 40 g/cm, and more preferably between 10 and 25 g/cm.

The adhesion-controlling layer 17 can be chosen to either increase or decrease the force necessary to cause delamination of the splicing tape 10 having no adhesion-controlling layer 17. In case the carrier layer 13 is of plastic, it may be desirable to increase the force necessary to cause delamination of the splicing tape 10 because in that case, the peel force c may be so small that a splicing tape 10 comprising no adhesion-controlling layer 17, could delaminate during handling. Alternatively, the surface of the carrier layer 13 may be given a corona treatment to increase the peel force c.

The adhesion-controlling layer 17 typically includes a release material such as silicone or fluorine containing material. Particularly suitable materials are silicone-containing materials. By varying the amount of silicone in the adhesion-controlling layer 17, the force required for delaminating the splicing tape 10 between the adhesion-controlling layer 17 and the non-tacky polymer layer 14 or the carrier layer 13, respectively, can be adjusted as desired. A particularly desirable release material for the adhesion-controlling layer 17 is an aqueous emulsion of silicone latex, available from Rhone-Poulenc as Silicolease® emulsion system, further containing a hydrophilic binder such as hydroxyethyl cellulose. Still further materials for use in the adhesion-controlling layer 17 include the release materials described in EP-A0618509. U.S. Pat. No. 5,202,190 and U.S. Pat. No. 5,032,460. According to a still further embodiment of the present invention, a polyurethane layer can be used as the adhesion-controlling layer 17. The latter offers the advantage that after delamination, the surface of the carrier layer 13 containing the adhesion-controlling layer 17 will be printable and writable.

The force required for delaminating the splicing tape 10 between the adhesion-controlling layer 17 and the non-tacky polymer layer 14 or the carrier layer 13, respectively, may also be adjusted by providing a patterned adhesion-controlling layer 17. For example, a silicone release material typically used to produce a release liner, may be applied by flexographic printing to the carrier layer 13 such that only about 50 to 95%, more preferably about 80 to 95% of the carrier's surface is covered by the release material. As a result, the peel force between the adhesion-controlling layer 17 and the non-tacky polymer layer 14 or the carrier layer 13, respectively, will be low at places where the release material covers the surface of the carrier layer 13 or the non-tacky polymer layer 14, respectively, and will be higher at places where such surfaces are not covered. Since the force necessary to cause delamination between the adhesion-controlling layer 17 and the carrier layer 13 or the non-tacky polymer layer 14, respectively, is the average of the force at a place where release material covers the carrier layer 13 or the non-tacky polymer layer 14, respectively, and where it does not cover such layers, the delamination force can be adjusted by varying the amount of surface coverage by the release material of adhesion-controlling layer 17.

The splicing tape of the present invention can be prepared in various ways. For example, in a first step the carrier layer 13 may be coated on its major surface with the adhesion-controlling layer 17. Such coating may be applied by well known coating techniques such as hopper or gravure coating followed by drying and/or curing. The second major surface of the carrier layer 13 may be optionally treated with a primer layer, followed by coating the first pressure sensitive adhesive layer 12 with subsequent curing and/or drying, and application of the release liner 11. Alternatively, the pressure sensitive adhesive layer 12 may be laminated to the second major surface of the carrier layer 13 as a transfer tape hearing a release liner 11 on its outer surface.

The non-tacky polymer layer 14 is then coated onto the adhesion-controlling layer 17. This may, for example, be accomplished by hopper coating or any other coating technique known in the art. Finally, the second adhesive layer 15 is coated or laminated to the non-tacky polymer layer 14, optionally followed by the application of a second release liner 16 to the exposed surface of the second adhesive layer 15. The second release liner 16 may be omitted when winding up the splicing tape 10 in roll form. Splicing tapes suitable for slicing a leading edge portion 34 of the outer turn 32 of a roll of sheet material 30 to another sheet material, which comprise an adhesion-controlling layer 17 are novel, and they are subject matter of the present invention.

The flying splice 10 according to the present invention is suitable for making a flying splice as is described above and is schematically shown in FIGS. 5*a* and *b* and 6. Splices of this type are preferably obtained by using splicing tapes 10 comprising an adhesion-controlling layer 17.

Figure 7:
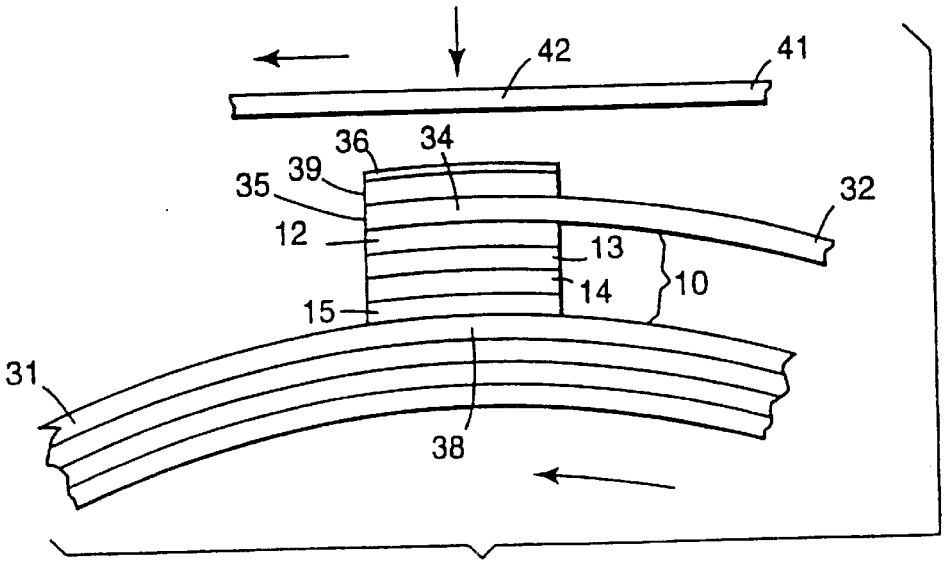
FIG. 7 shows another configuration of a new roll of sheet material which is "dressed" for the preparation of a flying splice, said configuration comprising a splicing tape 10 and another adhesive tape 39 which is attached to the upper-surface of the leading edge portion 34 of the outer turn 32 of the new roll 30 and comprises an additional adhesive surface protected by a release liner 36.
Figure 8:
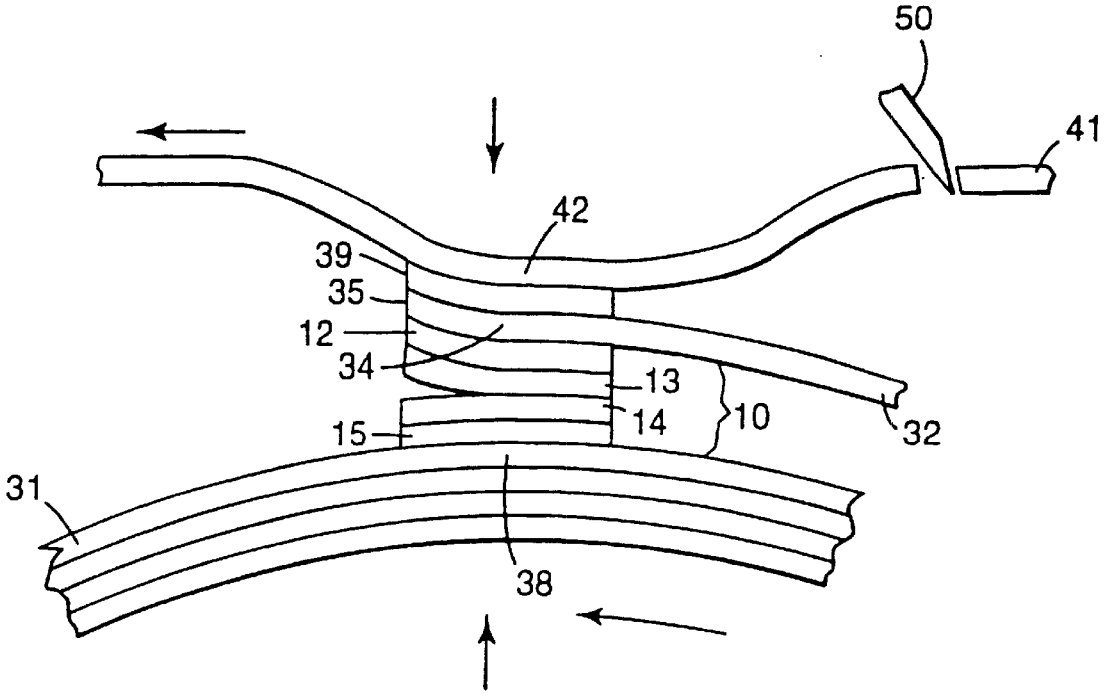
FIG. 8 shows the preparation of a flying splice between portion 42 of the running web sheet 41 of the depleting roll 40 and the outer turn 32 of the new roll of sheet material 30, using the configuration shown in FIG. 7 and pressing portion 42 against the exposed surface of adhesive tape 39.

The splicing tape 10 according to the present invention can also be used to make flying overlap splices as is shown in FIGS. 7 and 8. As can be seen from FIG. 7, subsequent to the application of the splicing tape 10, an adhesive tape 39 having two adhesive surfaces, is adhered with one adhesive surface to the upper-surface of the leading edge portion 34 of the out turn 32 of the new roll of sheet material 30. The adhesive tape 39 may consist of an adhesive layer which is preferably laminated to the upper-surface of the leading edge portion 34, for example, by means of a rubber roller with the outer surface of the adhesive layer being protected with a release liner 36. Coating of an adhesive layer 39 onto the upper-surface of the leading edge portion 34 of the outer turn 32 is also possible but less preferred. Adhesive tapes consisting of a single adhesive layer are often termed as transfer tapes. The adhesive tape 39 may also be a double-sided adhesive tape comprising a carrier layer (often referred to as backing) bearing an adhesive layer on each of its two major surfaces. The doubled-sided adhesive tape is also preferably laminated onto the upper-surface of the leading edge portion 34 of the outer turn 32 with the upper adhesive layer being protected by a release liner 36. The release liner 36 is then removed from the adhesive tape 39, and the new roll of sheet material 30 is ready for the splice making operation.

The adhesive layer or layers, respectively, and, optionally, the carrier layer of the adhesive tape 39 are preferably selected from the pool of materials described above for use in the splicing tape 10 or, alternatively, are selected following the guidelines given above. The adhesive layer or layers, respectively, preferably comprise pressure sensitive adhesive material with acrylate based pressure sensitive materials being especially preferred. The carrier layer of the adhesive tape 39, if present, preferably is a polymer layer or paper. The adhesive tape 39 preferably is repulpable. Furthermore, the adhesive tape 39 preferably is a transfer tape having a thickness of between 30–200 $\mu$m and, more preferably, of between 40–150 $\mu$m, in order to reduce the thickness of the splice. If a double-sided adhesive tape 39 is used, the adhesive layers preferably have a thickness independently from each other of between 30–150 $\mu$m and the carrier layer preferably is between 30–200 $\mu$m.

The splice making operation for the flying overlap splice which is preferably performed analogously to the method described above for the flying butt splice, and the splitting behavior of the splicing tape 10 is shown in FIG. 8. Flying overlap splices are preferably obtained by using splicing tapes 10 comprising an adhesion-controlling layer 17. It is evident from the comparison of the flying butt splice of FIG. 6 with the flying overlap splice of FIG. 8, that the flying overlap splice exhibits a higher step at the change from the trailing end of the web sheet 41 of the previous roll 40 to the leading edge portion 35 of the new roll 30. This step may cause problems, for example, in—or in the worst case disrupt—a subsequent printing process. On the other hand, the flying overlap splice construction may be advantageous in case the new roll 30 and the depleting roll 40 comprise different sheet materials. In this case, the first adhesive layer 12 of the splicing tape and the exposed adhesive layer of adhesive tape 39, respectively, may be selected to provide excellent adhesion to the leading edge portion 32 of the outer turn of the new roll 30 and to the portion 42 of the running web sheet 41 of the depleting roll 40, respectively.

Figure 1B:
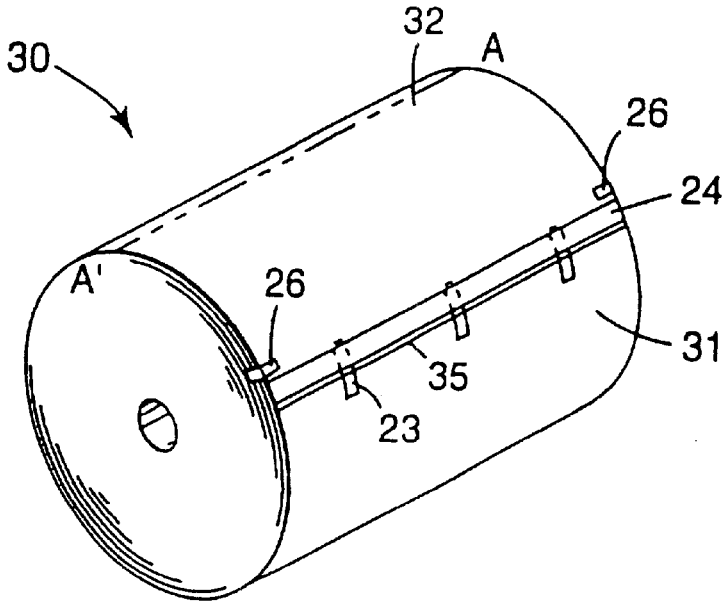

The splicing tape 10 of the present invention may also be used to prepare permanent splices. In this case, a first sheet material such as, for example, a new roll of sheet material 30 is prepared as shown in FIG. 5*a* or FIG. 7, respectively. The trailing end of the other sheet material 41 is then attached to the new roll to provide a permanent butt splice, a permanent overlap splice or a permanent staggered overlap splice construction similar to those of WO 95/29,115. Additional one-sided adhesive tapes 26 may optionally be additionally used as is shown in FIGS. 1A and 1B in order to further secure the splice. Splicing tapes 10 according to the present invention comprising an adhesion-controlling layer, are preferred.

The splicing tape 10 according to the present invention may also be used to provide an assembly comprising a first surface and a second surface, the first surface being releasably adhered to the second surface, by adhering the first adhesive layer 12 of the flying splice tape 10 to the first surface and the second adhesive layer 15 to the second surface.

The splicing tape 10 according to the present invention may also be used as nose tab or core starting tape. In the latter application, splicing tape 10 is first applied to the core of a roll by means of adhesive layer 15. The sheet material is then adhered to the core by means of adhesive layer 12 of the splicing tape 10 and wound around the core to give a roll of sheet material 30. Upon unwinding, the sheet material is properly released from the core leaving behind two non-tacky surfaces.

The splicing tape 10 according to the present invention exhibits highly advantageous properties.

On delamination, the splicing tape 10 provides two non-tacky surfaces. If an adhesion-controlling layer 17 is present, the splicing tape 10 provides on delamination the surface of the adhesion-controlling layer 17 which typically is non-tacky together with the surface of the non-tacky polymer layer 14 or the carrier layer 13, respectively, depending on the relative adhesion forces and the delamination scheme. Splices with non-tacky surfaces are preferred in that they do not adversely affect further processing of the spliced web sheet, for example, in a printing machine.

Contrary to the nose tab described in GB 2,294,235, the splicing tapes 10 of the present invention exhibit an adhesive delamination mode, i.e. the splicing tape delaminates between two layers instead of cohesively breaking through one layer. The adhesive force between the carrier layer 13 and the non-tacky polymer layer 14 and, in particular, between the adhesion-controlling layer 17 and the carrier layer 13 or the non-tacky polymer layer 14, respectively, can be varied and optimized with respect to a specific application by selecting appropriate combinations of materials for the respective layer and/or using an appropriately patterned adhesion-controlling layer 17. This high variability allows the splicing tape 10 of the present invention to be applied, for example, in the construction of FIG. 5*b* in order to prepare a new roll of sheet material 30 for making a flying splice. This construction which can be easily applied by one operator only, reliably prevents air from lifting the outer turn 32 of the new roll 30. Contrary to this, the cohesive strength of a layer can only be changed by changing the chemical composition of this layer. Controlling and varying the splitting behavior of a splicing tape 10 having a cohesive failure mode is therefore more difficult, and GB 2,294,235 consequently only discloses a nose tab. The cohesive strength of the silicon lacquer layer which is the predetermined cohesive breaking point of such nose tab, can only be reduced by providing a strip pattern as is indicated in FIG. 1 of GB 2,294,235.

Contrary to the flying splice tapes referred to in German utility model DE 92 01 286.8 U1, the splicing tapes 10 of the present invention comprise an adhesion-controlling layer 17.

Test methods

1. Adhesion force a between the first adhesive layer 12 and carrier layer 13

The adhesion force a is measured as 90° peel adhesion using a modified version of PSTC Method PSTC-3 which is available from the Pressure Sensitive Tape Council of Glenview, Ill., U.S.A.

A polyester film (thickness 23 μm) having a free end, was laminated onto adhesive layer 12 adhered to carrier layer 13 and a 2.54 cm wide strip of the resulting laminate was obtained. The carrier layer 13 of this strip was then bonded to a stainless steel plate using high tack double-sided adhesive tape number 411 available from Minnesota Mining and Manufacturing Company, St. Paul, Minn., U.S.A.

The adhesion force a is measured at room temperature by removing the free end of the polyester film away from the stainless steel plate by 90° at a rate of 300 mm/min using an Instron tensile tester.

2. Adhesion force b between the second adhesive layer 15 and the non-tacky polymer layer 14

The adhesion force b is measured as 90° peel adhesion using a modified version of PSTC Method PSTC-3 which is available from the Pressure Sensitive Tape Council of Glenview, Ill., U.S.A.

The non-tacky polymer layer 14 was coated onto a Silicote 6625 (57 g/m$^2$) paper substrate available from Ahlstrom Paper Group, and dried. Adhesive layer 15 was applied to the non-tacky polymer layer 14, and then a polyester film (thickness 23 μm) having a free end, was laminated onto adhesive layer 15. A 2.54 cm wide strip of the resulting laminate was then bonded to a stainless steel plate using high tack double-sided adhesive tape number 411 available from Minnesota Mining and Manufacturing Company, St. Paul, Minn., U.S.A.

The adhesion force b is measured at room temperature by moving the free end of the polyester film away from the stainless steel plate by 90° at a rate of 300 mm/min using an Instron tensile tester.

3. Adhesion force c between the non-tacky polymer layer 14 and the carrier layer 13

The adhesion force c is measured as 90° peel adhesion using a modified version of PSTC Method PSTC-3 which is available from the Pressure Sensitive Tape Council of Glenview, Ill., U.S.A.

A three-layer structure comprising in the order given the adhesive layer 15 bonded to non-tacky polymer layer 14 which was attached to carrier layer 13, was provided and a polyester film (thickness 23 μm) having a free end, was laminated onto adhesive layer 15. A 2.54 cm wide strip of the resulting laminate was then bonded to a stainless steel plate using high tack double-sided adhesive tape number 411 available from Minnesota Mining and Manufacturing Company, St. Paul, Minn., U.S.A.

The adhesion force c is measured at room temperature by moving the free end of the polyester film away from the stainless steel plate by 90° at a rate of 300 mm/min using an Instron tensile tester.

4. Adhesion force f between the adhesion-controlling layer 17 and the non-tacky polymer layer 14

The adhesion force f is measured as 90° peel adhesion using a modified version of PSTC Method PSTC-3 which is available from the Pressure Sensitive Tape Council of Glenview, Ill., U.S.A.

A three-layer structure comprising in the order given the carrier layer 13, the adhesion-controlling layer 17 and the non-tacky polymer layer 14, was laminated to one-sided adhesive tape no. 810 available from Minnesota Mining and Manufacturing Company, St. Paul, Minn., U.S.A., the backing of which having a free end. Then a 2.54 cm wide strip of the resulting laminate was obtained. The carrier layer 13 of this strip was then bonded to a stainless steel plate using high tack double-sided adhesive tape number 411 available from Minnesota Mining and Manufacturing Company, St. Paul, Minn., U.S.A.

The adhesion force f is measured at room temperature by moving the free end of the polyester film away from the stainless steel plate by 90° at a rate of 300 mm/min using an Instron tensile tester.

EXAMPLE 1 a) The following coating solutions were prepared:

Coating solution for the adhesion-controlling layer 17 (coating solution 1-A): 33 parts of polyvinylalcohol modified with 67 parts of octadecyl isocyanate were dissolved in toluene in an amount of 6.7%.

Coating solution for the non-tacky polymer layer 14 (coating solution 1-B): An aqueous solution containing the following components was prepared:

| | |
|---|---|
| Polyvinylalcohol (Mowiol ™ 4-88, available from Clariant) | 94.5% |
| Diethylene glycol | 5.0% |
| p-Hydroxymethylbenzoate | 0.3% |
| p-Hydroxypropylbenzoate | 0.1% |
| Surfynol ™ 336 (available from Air Products) | 0.1% |

Coating solution for the adhesive layers (coating solution 1-C) 12 and 15, respectively: A 40% solids solution in a 1:1 mixture of ethyl acetate and methanol was prepared containing 100 parts of acrylic copolymer of butyl acrylate and acrylic acid (75/25), 75 parts of a hydrogenated rosin acid tackifier, 70 parts of mono-fenyl ether of tetraethylene glycol (or tetraphenyl glycol phenyl ether) as a plasticizer and 65 parts of N-methyldiethanolamine as a neutralizing agent.

b) Preparation of the splicing tape 10:

Silcote 6625 paper (57 g/m$^2$) available from Ahlstrom Paper Group was used as the carrier layer 13. Silcote 6625 is a smooth paper that has been provided on one side (hereinafter A-side) with a barrier coating containing a latex polymer, silicates and starch. The opposite side of the paper was uncoated (B-side).

The A-side of the paper was coated with coating solution 1-A using Meyer bar coating with a 35 μm wire and parallel bar speed. The coating was dried and the obtained dry coating thickness was about 2–3 μm.

To this layer was then coated the coating solution 1-B using a nip feed coater with a feed gap of 40 μm. The coating was dried at an elevated temperature and the obtained dry coating thickness was about 8–13 μm. A coated paper sample A was thus obtained.

Separately, there was coated the coating solution 1-C to a siiconized release liner using nip feed coating with a 100 μm gap. After drying, a coating thickness of about 35 μm was obtained.

The adhesive coated release liner thus obtained was laminated with the adhesive layer on the coated side (side A) of the coated paper sample A. At the opposite side of the paper sample (side B), an adhesive layer was provided by transferring the adhesive layer from the above prepared adhesive coated release liner to the paper. The resulting splicing tape 10 was wound to a roll.

c) Preparation of a flying splice:

A 1.2 m wide roll of 72 g/m$^2$ weight paperstock was dressed for use as the new roll 30. A strip of the splicing 10 tape obtained above in b), measuring 1.2 m in length (same as the width of the roll) and being 50 mm wide was used to adhere the leading edge portion 35 of the outer turn 32 to the next-to-outer turn 31 of the new roll 30 in the configuration shown in FIGS. 5*a* and 5*b*. The tape was applied along the width of the entire leading edge 35 of the outer turn 32 (FIG. 5*b*) in such a position (FIG. 5*a*) so that the leading edge 35 was adhered to the next-to-outer turn 31 of the paper roll, but also so that portion 12A of the first pressure-sensitive adhesive layer 12 of the splicing tape 10 was not covered by the leading edge portion 34. Approximately 15 mm of the tape width was covered by the leading edge portion 34 and 35 mm was left exposed and available to make the adhesive bond with the running web sheet 41 of the old roll 40.

The new paper roll 30 bearing the above splicing tape 10 in the configuration just described was brought up to the traveling speed of the running web sheet 41 on conventional paper web handling equipment. A flying splice was performed at 400 m/min as shown schematically in FIG. 6. The splicing tape 10 clearly delaminated between the adhesion-controlling layer 17 and the non-tacky polymer layer 14, and the flying butt splice obtained remained intact during the subsequent processing at 400 m/min.

d) Measurement of peel forces a and b

Peel forces a and b were measured as is described in the test method section above using the layers specified in Example 1. The following values were obtained:

a=240 g/cm b=160 g/cm

EXAMPLE 2

The splicing tape of Example 1 was employed in the manner shown in FIG. 7. A piece of tape of the invention measuring 1.2 m×50 mm was adhered along the entire leading edge 35 of the outer turn 32 of the new paper roll 30 in such a manner that both of the adhesive surfaces of the tape were fully covered and used to bond the outer turn 32 to the next-to-outer turn 31. No pressure-sensitive adhesive was exposed.

A separate length of double-coated pressure-sensitive adhesive tape 39 (Tape number 415 from 3M Company, St. Paul, Minn., USA) having a length of 1.2 m and a width of 50 mm was adhered separately to the outer surface of the leading edge 35 of the outer turn 32 as shown in FIG. 7. The protective release liner 36 was removed from this tape, exposing the adhesive surface as shown in FIG. 8.

The new paper roll 30 dressed for making the splice, was brought up to the traveling speed of the running web sheet 41 on conventional paper web handling equipment. A flying splice was made at 400 m/min as shown schematically in FIG. 8. The splicing tape 10 clearly delaminated between the adhesion-controlling layer 17 and the non-tacky polymer layer 14, and the flying overlap splice obtained remained intact during the subsequent processing at 400 m/min.

EXAMPLES 3 to 7 a) Preparation of splicing tape:

A paper (ADERCOTE™ Gerfast 80 g/m$^2$ available from Ahlstrom Paper Group) coated on one side with a latex polymer (A-side) and uncoated on the other side (B-side) was provided. A silicon release composition as shown in Table 1 was then coated to the A-side of the paper using doctor blade coating without a shim. A very thin adhesion-controlling layer 17 was thus obtained. The coating solution 1-B of example 1 was coated onto the adhesion-controlling layer 17 at a dry thickness of 8–12 μm, followed by applying the adhesive coating solution 1-C of example 1 at a dry thickness of 38–45 μm. The adhesive layer was dried and protected with a release liner. The adhesive coating solution 1-C was coated to the opposite side (B-side) of the paper at a dry thickness of 38–45 μm, and this adhesive layer was also protected with a release liner.

TABLE 1

| | Example number | | | | |
|---|---|---|---|---|---|
| Release composition | 3 | 4 | 5 | 6 | 7 |
| A700 | 40 | 40 | 40 | 40 | 40 |
| 71822 | 0.64 | 0.8 | 0.96 | 1.12 | 1.28 |
| 71823 | 0.064 | 0.08 | 0.096 | 0.112 | 0.128 |
| 71806 | 0.0256 | 0.032 | 0.0384 | 0.0448 | 0.0512 |
| Peel force f [g/cm] | 25 | 22 | 20 | 20 | 17 |

Notes:

(1) Amounts of the components of the coating solution in grams.

(2) The components of the release coating were specifically:

A700 is a solution of a silicone latex in water (40% solids) (Silicolease™ A700 available from Rhône-Poulenc), 71822 is a solution of a silicone polymer in water (41.5% solids) (Silicolease™ 71822 available from Rhône-Poulenc), 71823 is a solution of a catalyst in water (40.9% solids) (Silicolease™ 71823 available from Rhône-Poulenc), and 71806 is a solution of crosslinker in water (57% solids) (Silicolease™ 71806 available from Rhône-Poulenc).

b) Measurement of peel force f

The peel force f was measured as is described in the test section above using the layers as specified in Examples 3–7. The results are summarized in table 1.

What is claimed is:

1. Method of splicing a leading edge portion (34) of the outer turn (32) of a roll of sheet material (30) to a further sheet comprising the steps of (i) providing a splicing tape (10) comprising a carrier layer (13) having on a first major surface a first adhesive layer (12) and on a second major surface opposite to the first major surface in the order given an adhesion-controlling layer (17), a non-tacky polymer layer (14) and a second adhesive layer (15), the splicing tape being capable of delamination between the carrier layer (13) and the adhesion-controlling layer (17) or between the non-tacky polymer layer (14) and the adhesion-controlling layer (17), respectively, when preparing the splice, (ii) positioning said tape on and adhering it by means of one of the adhesive layers (12), (15), to the portion of the upper surface of the next-to-the-outer turn (31) of the roll of sheet material (30) facing the leading edge portion (34) of the outer turn (32) so that the other adhesive layer of the splice tape (10) can be fully or partly adhered to the under-surface of the leading edge portion (34) of the outer turn (32), (iii) adhering the other adhesive layer of the splice tape to the under-surface of the leading edge portion (34) of the outer turn (32) of the roll of sheet material (30), (iv) optionally providing an adhesive tape (39) having a first adhesive surface and a second adhesive surface, and adhering one of the adhesive surfaces, respectively, to the upper surface of the leading edge portion (34) of the outer turn (32) of the roll of sheet material (30, (v) adhering the further sheet to the optionally partially exposed surface of the other adhesive layer of the splicing tape (10) and/or to the exposed surface of the other adhesive surface of said optional adhesive tape (39), and (vi) separating the further sheet and the outer turn of the roll splice to it, from the next-to-the-outer turn of the roll thereby effecting delamination between the carrier layer (13) and the non-tacky polymer layer (14) of the splicing tape (10).

2. Method according to claim 1 wherein the adhesion-controlling layer (17) and the non-tacky polymer layer (14) are selected so that the splicing tape (10) is capable of delamination between such layers when preparing the splice.

3. Method according to claim 2 wherein the force f necessary to peel the non-tacky polymer layer (14) from the adhesion-controlling layer (17) is between 5 and 40 g/cm.

4. Method according to claim 1 wherein the adhesion-controlling layer (17) of the splicing tape (10) comprises a polysiloxane or fluorinated polyurethane.

5. Method according to claim 1 wherein the non-tacky polymer layer (14) comprises a polymer selected from the group consisting of polyvinyl alcohols, polyvinyl chlorides and copolymers of vinyl acetate and vinyl chloride.

6. Method according to claim 1 wherein the carrier layer (13) comprises paper.

7. Assembly comprising a first and second sheet material spliced to each other, said assembly being obtainable by using a splicing tape (10) comprising a carrier layer (13) having on a first major surface a first adhesive layer (12) and on a second major surface opposite to the first major surface in the order given an adhesion-controlling layer (17), a non-tacky polymer layer (14) and a second adhesive layer (15), the splicing tape being capable of delamination between the carrier layer (13) and the adhesion-controlling layer (17) or between the non-tacky polymer layer (14) and the adhesion-controlling layer (17), respectively, when preparing the splice.

8. Splicing tape (10) suitable for splicing a leading edge portion (34) of the outer turn (32) of a roll of sheet material (30) to another sheet material, said splicing tape comprising a carrier layer (13) having on a first major surface a first adhesive layer (12) and on a second major surface opposite to the first major surface in the order given an adhesion-controlling layer (17), a non-tacky polymer layer (14) and a second adhesive layer (15), the splicing tape being capable of delamination between the carrier layer (13) and the adhesion-controlling layer (17) or between the non-tacky polymer layer (14) and the adhesion-controlling layer (17), respectively, when preparing the splice.

9. Splicing tape (10) according to claim 8 wherein the adhesion-controlling layer (17) and the non-tacky polymer layer (14) are selected so that the splicing tape (10) is capable of delamination between such layers when preparing the splice.

10. Splicing tape (10) according to claim 9 wherein the force f necessary to peel the non-tacky polymer layer (14) from the adhesion-controlling layer (17) is between 10 and 25 g/cm.

11. Splicing tape (10) according to claim 8 wherein the adhesion-controlling layer (17) of the splicing tape (10) comprises a polysiloxane or fluorinated polymer.

12. Splicing tape (10) according to claim 8 wherein the non-tacky polymer layer (14) comprises a polymer selected from the group consisting of polyvinyl alcohols, polyvinyl chlorides and copolymers of vinyl acetate and vinyl chloride.

13. Splicing tape (10) according to claim 8 wherein the carrier film layer (13) comprises paper.

* * * * *